United States Patent [19]

Levenspiel et al.

[11] 4,408,656

[45] Oct. 11, 1983

[54] COUNTERCURRENT HEAT EXCHANGER FOR TWO STREAMS OF SOLIDS USING HEAT PIPES

[76] Inventors: Octave Levenspiel; Riley T. Chan, both of 1634 NW. Crest Pl., Corvallis, Oreg. 97330

[21] Appl. No.: 299,296

[22] Filed: Sep. 3, 1981

[51] Int. Cl.[3] ..... F28D 15/00

[52] U.S. Cl. ..... 165/1; 165/104.26; 165/DIG. 27; 165/DIG. 12; 432/82

[58] Field of Search ..... 165/104.16, 104.14, 165/DIG. 27, DIG. 12, 104.26; 432/82, 83, 84, 90, 91

[56] References Cited

U.S. PATENT DOCUMENTS

| | | |
|---|---|---|
| 3,524,498 | 8/1970 | Galer . |
| 3,705,620 | 12/1972 | Kayatz . |
| 3,866,673 | 2/1975 | Pavlov et al. . |
| 3,925,190 | 12/1975 | Whitcombe et al. . |
| 4,157,245 | 6/1979 | Mitchell et al. . |

FOREIGN PATENT DOCUMENTS

| | | | |
|---|---|---|---|
| 2340525 | 9/1977 | France | 165/104.14 |
| 54-9050 | 1/1979 | Japan | 165/104.15 |
| 54-32864 | 3/1979 | Japan | 165/104.15 |
| 55-110884 | 8/1980 | Japan | 165/104.16 |

OTHER PUBLICATIONS

Potter, O. E., *Energy Recovery From Hot Particulates*, Australian IMM Conference, Sydney, Australia, 7/1981.

*Primary Examiner*—Albert W. Davis, Jr.
*Attorney, Agent, or Firm*—David L. Garrison

[57] ABSTRACT

Disclosed are apparatuses and methods for transferring heat from a relatively hot stream of solid materials to a relatively cold stream of solid materials. Both streams cascade downward under the force of gravity over a series of heat pipes which are arranged between the streams to transfer heat therebetween. The heat pipes are arranged so they provide countercurrent heat transfer between the two materials streams. The invention is shown applied to a process for recovering hydrocarbons from shale rock.

7 Claims, 4 Drawing Figures

COUNTERCURRENT HEAT EXCHANGER FOR TWO STREAMS OF SOLIDS USING HEAT PIPES

TECHNICAL FIELD

This invention relates to apparatus and methods for achieving countercurrent transfer of heat between two streams of solids, using gravity flow of both streams of solids, and without directly mixing the two materials.

BACKGROUND ART

Heat exchangers include devices for transferring heat from a hot flowing stream to a cold flowing stream of material. Countercurrent heat exchange is the preferred arrangement for heat exchangers because then one can approach 100% heat recovery. With significant resistance to heat transfer, with deviation from plug flow, or with unequal flow of the two streams the heat recovery drops. With cocurrent heat transfer, even with negligible resistance to heat transfer, the average heat recovery for the two streams can never exceed 50%.

Since countercurrent heat exchange is much more efficient than cocurrent heat exchange it is aimed for and designed into heat exchangers whenever possible. With gases and liquids one can approach countercurrent exchange with no difficulty, the fluids are pumped in opposite directions, whether sideways or up and down. In gas/solid systems one can approach countercurrent heat exchange in various ways, such as with moving beds of downflowing solids combined with upflowing of gas, with raining solid contactors, staged fluidized beds, and other devices. U.S. Pat. Nos. 3,524,498; 3,705,620; 3,866,673 and 3,925,190 are examples of such systems.

In solid/solid systems the designer is faced with the difficulty that solids can only flow downward of themselves thus leading to cocurrent contacting and cocurrent heat exchange with its inherently low heat recovery.

Various methods have been proposed for overcoming this difficulty. When both streams consist of fine solids one may employ a third stream of solids consisting of large particles such as steel balls as heat carrier and go between. Thus in the first processing unit the falling steel balls pick up heat from the hot fines which are being transported upward pneumatically by a fast moving gas stream. The steel balls then give up their heat in the second similar unit to the upflowing cold fines. U.S. Pat. Nos. 4,110,193 and 4,157,245 are examples of such processes.

In principle these processes seem straightforward. In practice they are very complex systems requiring all sorts of mechanical seals, plus large gas flows to carry the solids upward. This absorbs much of the heat. In addition the upflowing solids will deviate greatly from plug flow thereby reducing the thermal efficiency drastically. Such systems entail considerable complexity when compared to this invention.

DISCLOSURE OF INVENTION

It is one object of this invention to provide countercurrent type heat transfer between two streams of solid materials without the materials being mixed.

It is also an object of this invention that the two solid materials between which heat is being transferred be handled by cascading them under the force of gravity through a heat transfer device, thus eliminating the need for pneumatic transport air, or conveyor belts, or fluidized beds or other relatively complex materials handling equipment; and also allowing the handling of solids in all size ranges from large to very small.

A further object of this invention is to provide a system in which heat transfer is as simple as possible by eliminating pumps, equipment, and piping associated with forced fluid or fluidized bed heat transfer systems.

The foregoing objects of this invention may be accomplished by transfer of heat from one solid material stream to another solid material stream by containing the moving streams of solids in a vessel having two separate sections or in two separate vessels. The hot solid material stream flows through the cooling section or vessel where it is cooled. The cool solid material stream flows through the heating section or vessel where it is heated.

To achieve countercurrent heat transfer in the face of cocurrent flow of the two streams of solids requires that heat released by the hot incoming solids at the top of the cooling vessel be absorbed by the outgoing cold stream at the bottom of the heating vessel. Similarly, heat released at the bottom of the cooling vessel must be transferred to the entering cold solids at the top of the exchanger. This is done by using a plurality of properly arranged heat pipes. The heat pipes employed in this invention are well-known in the art of thermal engineering, are available from commercial manufacturers, and are discussed in books such as P. Dunn and D. A. Reay, *Heat Pipes,* 2nd Ed., (Pergamon Press, 1978).

Basically the heat pipe is a device which very efficiently allows heat absorbed at one location to be released at a second location, not necessarily nearby. Each pipe consists of a sealed tube containing an appropriate working fluid which evaporates at the hotter end while absorbing heat. The vapor flows to the cooler end and condenses there while releasing its latent heat of vaporization. The condensate them flows back to the hot end by capillary action with or without the help of gravity. Proper arrangement of the heat pipes is the means by which countercurrent heat transfer is achieved in the face of the cocurrent downflow of both solid streams.

In one embodiment of this invention an array of heat pipes are connected at their heat receiving ends to a lower vessel in which hot solid materials to be cooled are flowing downwardly under the influence of gravity. Heat is transferred to the heat pipes causing the liquid contained therein to be vaporized. The other end of the heat pipes, properly arranged, projects into a second upper vessel in which cool solid materials to be heated are flowing downwardly under the influence of gravity. The vapor contained in the heat pipe condenses on the walls of the heat pipe giving up its latent heat of vaporization to the solid material by heat transfer through the heat pipe wall. The cooled and condensed heat transfer liquid then flows downwardly through the heat pipe to be re-vaporized in the lower vessel.

Since the major resistance to heat transfer occurs between the solid stream and pipe surface, and not within the pipe itself, it is desirable to increase the available area for transferring heat to and from the heat pipes by constructing the heat pipes with fins. The fins can be of various designs, including parallel plates which are slanted from the vertical and spiral heat fins. These designs cause the solid material stream to strike the fins at an angle, thereby increasing the heat transfer rate. It is also possible to add additional gas flow within one or both of the solid materials handling sections so that improved flow characteristics are obtained.

BEST MODE OF CARRYING OUT THE INVENTION

Figure 1:
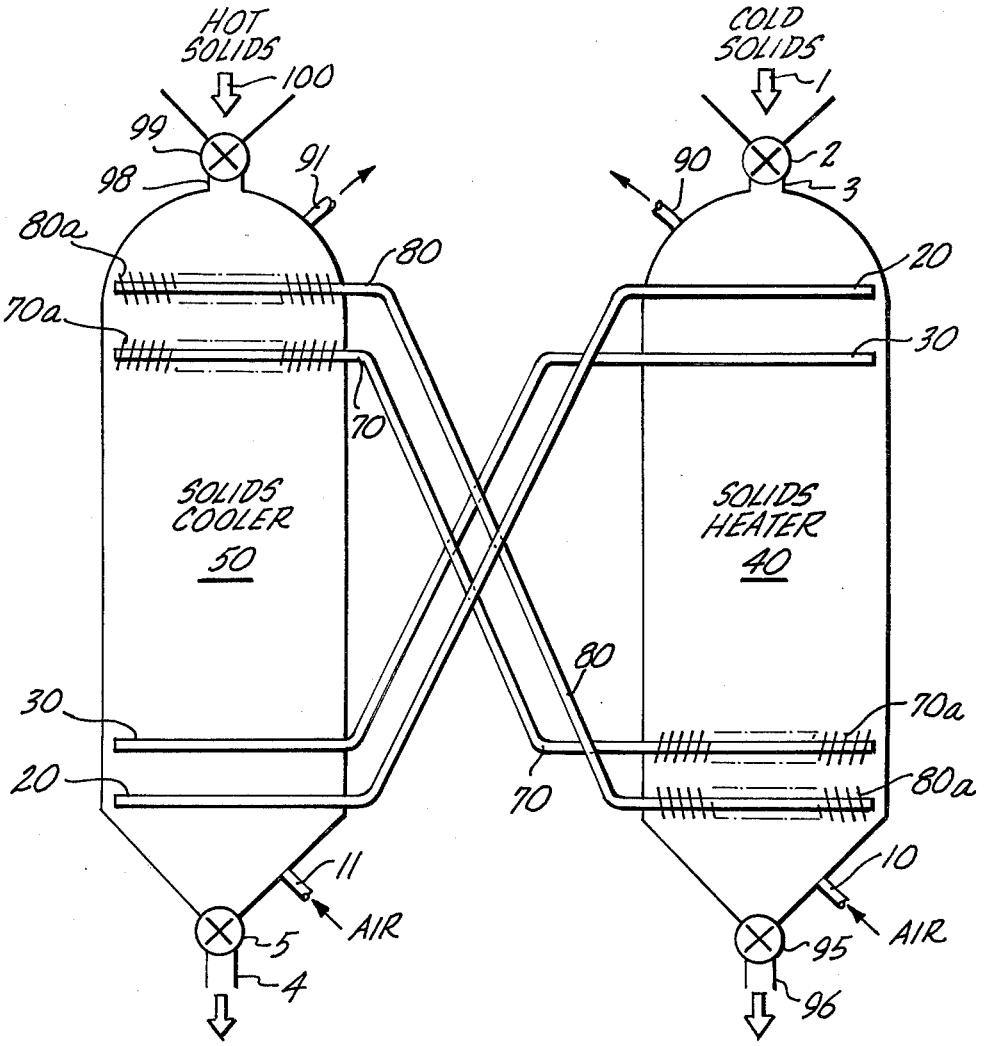
FIG. 1 is a schematic side elevational view of an embodiment of the invention wherein the heating and cooling sections of the exchanger are located side by side. In this arrangement only about half of the heat pipes experience gravity return of the condensate.

Shown in FIG. 1 is one arrangement of the countercurrent heat transfer system. Cooling section or vessel 50 is supplied with a downwardly flowing stream of relatively hot solids 100 which enters through gas seal 99 at entrance 98 and exits at gas seal 5. Heating section or vessel 40 is supplied with a downwardly flowing stream of cold solids 1, which enters through gas seal 2 at entrance 3. The crushed solid is heated in heating vessel 40 as it cascades over heat pipes 20, 30, 70 and 80. Heat pipes 20, 30, 70 and 80 are merely representative, greater or fewer numbers may be required according to heat transfer requirements and cost limitations. In general, the greater the number of heat pipes the greater the heat transferred.

Heat pipes 20, 30, 70 and 80 are arranged with portions of each within both cooling vessel 50 and heating vessel 40. The heat transfer fluid vapor within the heat pipes is condensed within the heating section 40 by the passage of the cold material 1 over the exterior of the heat pipes.

Heat pipe 80 as shown receives heat from the hot solids near the inlet 18 of solids cooling vessel 50 and gives up heat to the solids being heated near the outlet 96, whereby substantially countercurrent heat transfer results, even though both streams of solids are gravity fed. Similarly, heat is transferred from the relatively cooler solids at the bottom of cooling vessel 50 via heat tube 20 to the cool solids entering heating vessel 40 adjacent inlet 3.

As can be seen from FIG. 1, the condensate is able to flow by gravity from the heating section 40 to the cooling section 50 only within heat pipes 20 and 30. In heat pipes 70 and 80 it is necessary that the condensate be moved upwardly. This upward movement of the condensate is accomplished by providing the heat pipes with a wick or other means for capillary action to transfer the condensate upward, as is well-known in the art of heat pipes.

Ports 10, 11, 90 and 91 are for the inflow and outflow of either a steady stream or occasional pulse of gas, if needed for better control of this operation.

Cooling and heating sections can be in separate vessels as shown in FIG. 1 or can both be enclosed in one shell (not shown).

Figure 2:
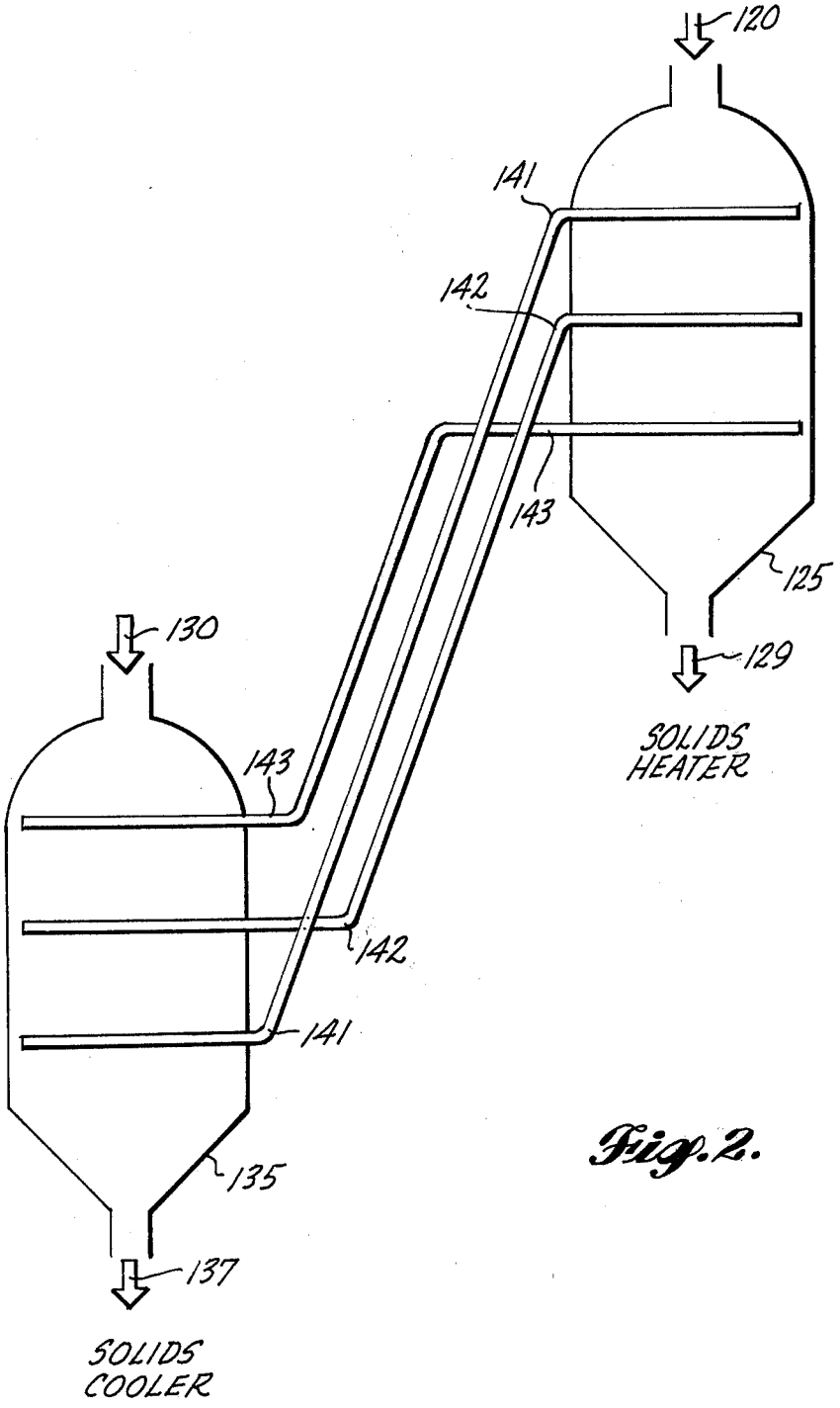
FIG. 2 is an alternative embodiment of the invention wherein the solids cooling section of the exchanger is located at a level below the section wherein solids are heated. In this arrangement all heat pipes have gravity return of condensate.

Another embodiment shown in FIG. 2 can be constructed so that all the heat pipes 141, 142 and 143 are at a higher elevation in the heating vessel 125 than in the cooling vessel 135. Such an arrangement allows the condensate to flow from the heating vessel 125 to the cooling vessel 135 within the heat pipes 141,42 and 143 under the force of gravity. The relatively cold stream 120 enters heating vessel 125 and cascades downwardly over heat pipes 141, 142 and 143, exiting as warm stream 129. A related or completely independent hot stream 130 enters cooling vessel 135 and cascades over heat pipes 141, 142 and 143. Heat is transferred from the cooling vessel 135 to the heating vessel 125 through the operation of the heat pipes as discussed above.

Heat pipes can be advantageously used with heat conducting fins located upon the heat pipes in both the heating and cooling sections. An example of fins which will add to the thermal efficiency of this heat transfer recovery process are shown in FIG. 1 where heat pipes 70 and 80 are shown with slanted fins **70*a* and 80*a***. These slanted fins are alternatively directed so that the solid material flows in a back and forth movement. Other alternative cooling fin designs are possible, including spiral fins, if compatible with the types of solid material streams which are being cooled or heated.

Figure 3:
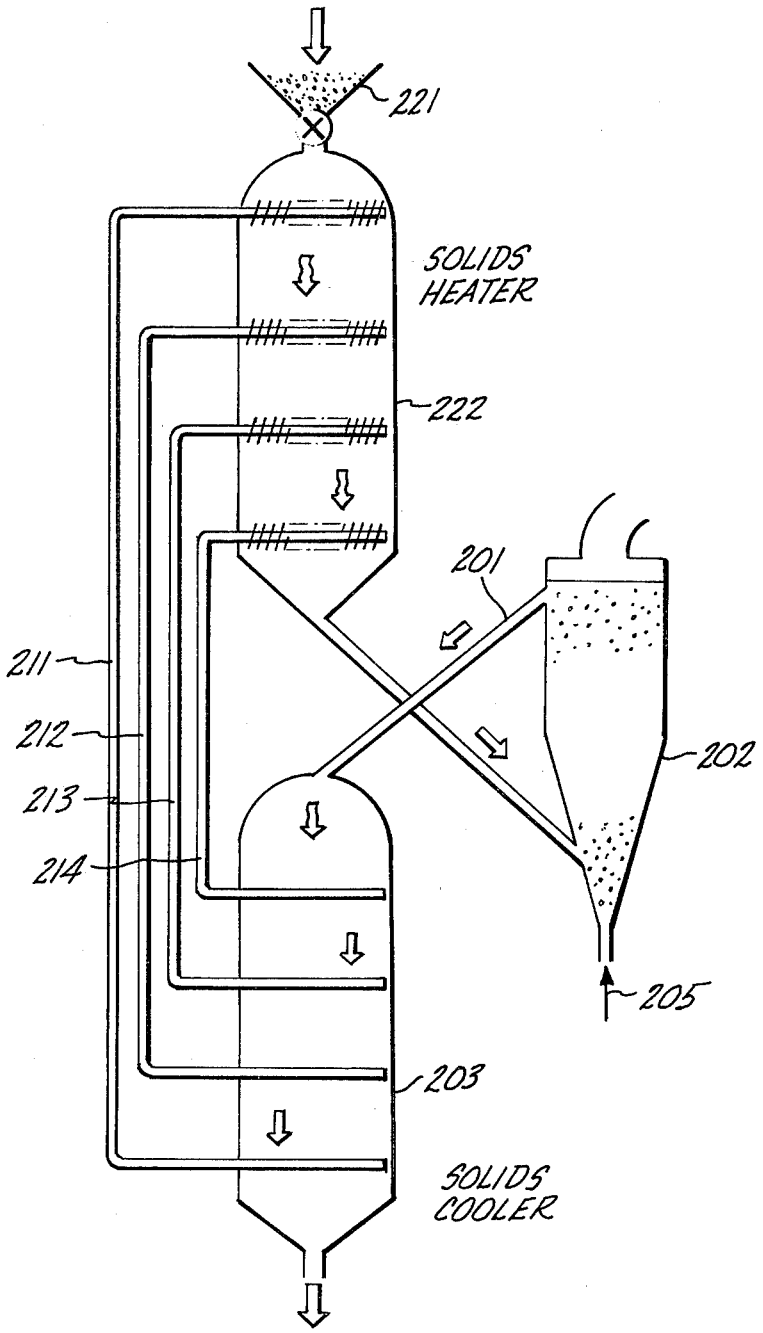
FIG. 3 shows how this invention can be used in processes which involve the high temperature endothermic processing of solids.

FIG. 3 shows how heat is recovered from hot spent solids from a high temperature process occurring in high temperature solids processor 202. High temperature solids processor 202 can be of various types such as a drier, devolatilizer or reactor. Cold solids 221 enter the solids heater 222 and are heated when they cascade over heat pipes 211–214. The heated solids are conveyed to the high temperature solids processor 202 by gravity. A fluidizing gas stream 205 conveys the heated solids upwards in solids processor 202 where they are removed and pass through line 201 by gravity to the solids cooler 203. The remaining heat in the hot solids is transferred to heat pipes 211–214 as the hot solids flow thereover.

Figure 4:
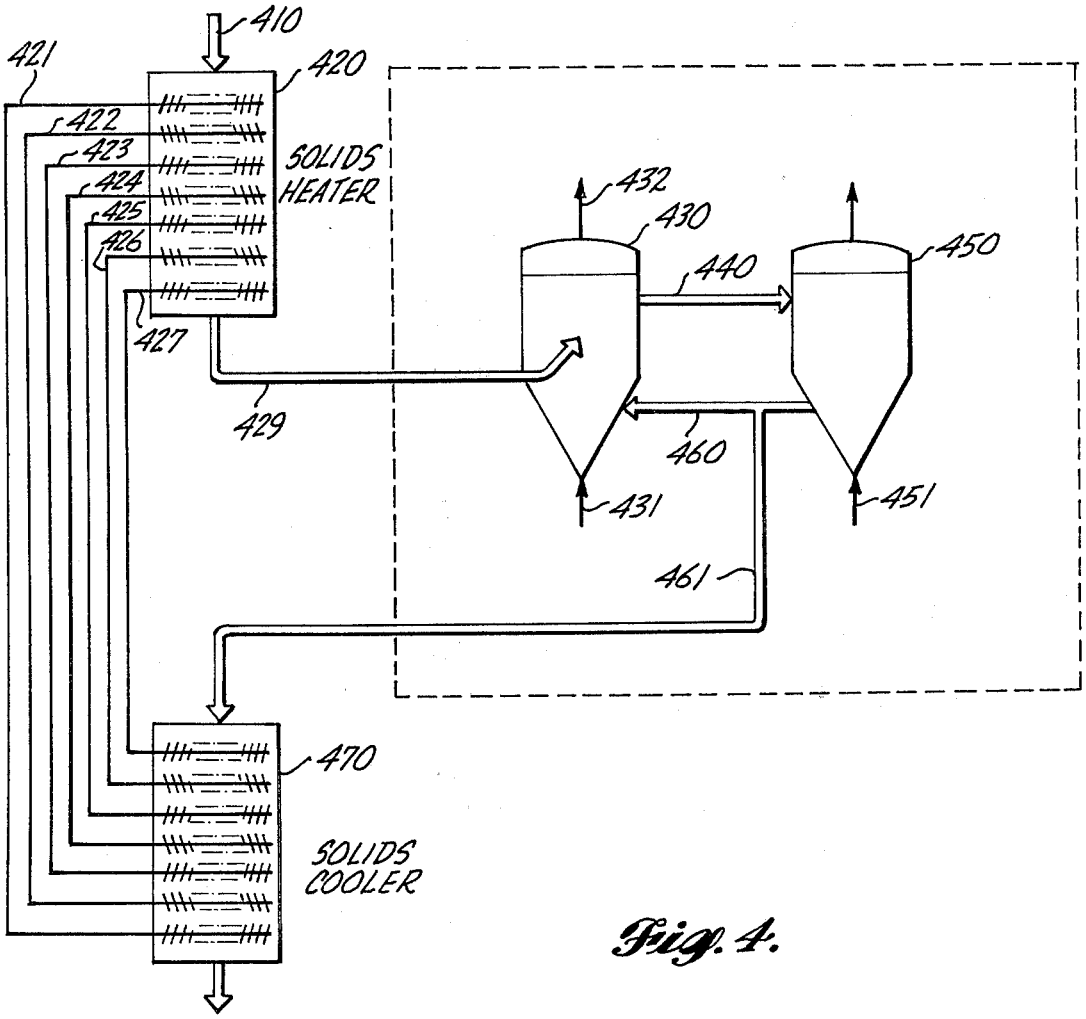
FIG. 4 shows how the invention can be used in a process for extracting hydrocarbons from shale.

In FIG. 4 is shown the use of the invention in a process for recovering hydrocarbons from shale rock. A stream of fresh cold shale 410 enters the shale heater 420 and cascades over a plurality of heat pipes 421–427. The heated fresh shale is then transported to a devolatilizer or retort 430 through line 429 operating at temperatures in the range of 370°–530° C. Steam is injected into the bottom of retort 430 at port 431. Hydrocarbon volatiles are drawn off at port 432. Shale moves from the retort 430 to the burner 450 through line 440. Air is injected into burner 450 at port 451. Very hot shale is returned from the burner 450 to the retort 430 through line 460. A portion of the very hot shale which is spent is conveyed by line 461 to shale cooler 470 where heat is given up to heat pipes 421 through 427.

Appropriate working fluids at appropriate pressures must be used in the heat pipes 421–427 depending upon the temperatures encountered during operation. For example, heat pipe 421 must transfer heat to fresh cold shale and receives its heat from the coldest part of the shale cooler 470. Thus water which has a useful temperature range of 30°–200° C. is appropriate as a working fluid. Similarly, heat pipe 427 is exposed to a higher temperature range so mercury having a useful working temperature range of 250°–650° C. is appropriate. The proper working fluids and pressures are well-known and fully available from commercial heat pipe manufacturers.

INDUSTRIAL APPLICABILITY

The invention can be used in any process where heat is transferred from a relatively hot solid material stream to a relatively cold solid material stream. Two specific examples of processes which can advantageously use the invention include hydrocarbon recovery from shale and pyrolization of volatiles from bituminous coals in a temperature range below the coking temperature.

What is claimed is:

1. An apparatus for transferring heat continuously in countercurrent flow from a stream of relatively hot solid materials to a stream of relatively cold solid materials, both streams being gravity fed, comprising:

a cooling section for containing said relatively hot solid materials which are passing therethrough, said cooling section having a hot solids inlet and a cooled solids outlet and having a plurality of heat pipes arranged therein for contacting a cascade of said relatively hot solid materials, whereby heat is transferred from said relatively hot solid materials to said heat pipes; a heating section for containing said relatively cold solid materials which are passing therethrough, said heating section having a cool solids inlet and a heated solids outlet and having continued portions of said plurality of heat tubes arranged therein for contacting a cascade of said relatively cold solid materials, whereby heat is transferred from said heat tubes to said relatively cold solid materials;

each of said heat pipes forming an enclosed vessel containing a heat transfer fluid which is vaporized in the portion of the heat pipe located in said cooling section and condensed in the portion of the heat pipe located in said heating secition, thereby transferring heat from the stream of hot materials to the stream of cold materials said heat pipes further being arranged so that those of said heat pipes positioned in said cooling section at the top thereof transfer heat to a position in said heating section at the bottom thereof.

2. The apparatus of claim 1 wherein said pipes are appropriately arranged so that the condensate of said heat transfer fluid in said heat pipes flows from said heating section to said cooling section under the force of gravity.

3. The apparatus of claim 1 or 2 wherein said heat pipes have fins thereon for increasing the rate of heat transfer between said heat pipes and said relatively hot or cold solid materials.

4. The apparatus of claim 1 wherein those of said heat pipes positioned at the bottom of said cooling section transfer heat to the top of said heating section.

5. A method for transferring heat in an essentially countercurrent fashion from relatively hot solid materials to relatively cold solid materials, comprising:

cascading said relatively hot solid materials flowing downwardly in a first vessel over a plurality of heat pipes; said heat pipes each forming an enclosed vessel containing a heat transfer fluid which is vaporized by heat transferred thereto from said cascading of hot materials thereover;

cascading said relatively cold solid materials flowing downwardly in a second vessel over a different portion of said heat pipes wherein said heat transfer fluid is condensed releasing heat which is transferred to said cold solid material, said heat pipes being arranged so that heat from solid material adjacent the inlet to said first vessel is transferred to material adjacent the outlet of said second vessel; whereby countercurrent heat transfer occurs between said relatively hot and cold solid materials.

6. The method of claim 5 wherein said heat transfer fluid or fluids contained within said heat pipe or pipes flow under the force of gravity from the portion of said heat pipe or pipes exposed to said relatively cold solid materials to the portion of said heat tube or tubes exposed to said relatively hot solid materials.

7. The method of claim 5 wherein heat from material adjacent the outlet of said first vessel is transferred to material adjacent the inlet of said second vessel.

* * * * *